US005209172A

United States Patent [19]

Kawaguchi et al.

[11] Patent Number: 5,209,172

[45] Date of Patent: May 11, 1993

[54] UPPER FABRIC FEED DEVICE FOR SEWING MACHINE, UTILIZING PARALLEL MOTION MECHANISM FOR RECIPROCATING FEED FOOT AND PRESSER FOOT

[75] Inventors: Yasuhiko Kawaguchi, Gifu; Yutaka Senda, Aichi; Masami Ito, Kagamihara; Hiroaki Onishi; Yoichi Kumanda, both of Nagoya, all of Japan

[73] Assignee: Brother Kogyo Kabushi Kaisha, Aichi, Japan

[21] Appl. No.: 864,343

[22] Filed: Apr. 6, 1992

[30] Foreign Application Priority Data

Apr. 12, 1991 [JP] Japan ..... 3-108562

[51] Int. Cl.[5] ..... D05B 27/04

[52] U.S. Cl. ..... 112/320

[58] Field of Search ..... 112/237, 239, 303, 311, 112/320, 321, 235, 238

[56] References Cited

U.S. PATENT DOCUMENTS

| | | | |
|---|---|---|---|
| 1,443,634 | 1/1923 | Moffatt et al. | 112/320 |
| 3,196,815 | 7/1965 | Von Hagen | 112/311 |
| 3,935,826 | 2/1976 | Nicolay et al. | 112/320 |
| 4,067,275 | 1/1978 | Willenbacher | 112/239 X |
| 4,116,145 | 9/1978 | Nicolay | 112/320 |
| 4,323,020 | 4/1982 | Thompson | 112/237 X |
| 4,422,398 | 12/1983 | Dusch | 112/320 |
| 4,446,803 | 5/1984 | Nicolay et al. | 112/320 |
| 4,611,548 | 9/1986 | Holl | 112/311 |
| 4,616,586 | 10/1986 | Scholl | 112/320 |
| 4,936,235 | 6/1990 | Klundt | 112/320 |

FOREIGN PATENT DOCUMENTS

| | | | |
|---|---|---|---|
| 2620209 | 11/1977 | Fed. Rep. of Germany | 112/320 |
| 0342981 | 7/1972 | U.S.S.R. | 112/320 |

*Primary Examiner*—Clifford D. Crowder
*Assistant Examiner*—Ismael Izaguirre
*Attorney, Agent, or Firm*—Oliff & Berridge

[57] ABSTRACT

An upper fabric feed device for a sewing machine, including a feet reciprocating mechanism for reciprocating feed and presser feet for feeding the work fabric on a throat plate. The reciprocating mechanism includes a first swing arm pivoted by a drive device, a pivotally supported parallel motion mechanism, a drive link mechanism which pivotally connects the first swing arm to the parallel motion mechanism, a pivotally supported second swing arm, a first connecting link pivotally connected to the parallel motion mechanism, a triangular lever connected to the first connecting link and second swing arm, and a second and a third connecting link connecting the triangular lever to the feed and presser feet, respectively. The parallel motion mechanism is supported pivotally about one of four apexes of the parallelogram defined by four motion links thereof. The feed and presser feet are both placed in fabric-contact positions when the distance between the two diagonally opposed apexes including the above-indicated one apex is the smallest.

14 Claims, 8 Drawing Sheets

UPPER FABRIC FEED DEVICE FOR SEWING MACHINE, UTILIZING PARALLEL MOTION MECHANISM FOR RECIPROCATING FEED FOOT AND PRESSER FOOT

BACKGROUND OF THE INVENTION

1. Field of the Invention

The present invention relates generally to an upper fabric feed device for a sewing machine, and more particularly to such an upper fabric feed device in which the velocities of feed and presser feet are zeroed or made close to zero when these feet contact or engage a work fabric.

2. Description of Related Art

As a conventional upper fabric feed device for a sewing machine, there is disclosed in U.S. Pat. No. 4,446, 803 a device wherein a feed foot and a presser or holddown foot are connected via respective rods to a triangular or ternary link or lever. To this triangular lever, there are connected a spring-biased arm, and a connecting link which in turn is connected to a slide. The slide is connected to a crank mechanism.

U.S. Pat. No. 4,422,398 shows another conventional upper fabric feed device, in which a first and a second motion mechanism are connected to each other and to a triangular lever. The first motion mechanism is connected via a first connecting link to a bell crank mechanism, which in turn is connected to the triangular lever. The second motion mechanism is connected to a swing arm, which in turn is connected to the first motion mechanism via a second connecting link which has the same length as the first connecting link.

However, the former conventional device requires a guide for slidably guiding the slide, which complicates the device and makes it difficult to fabricate the sewing head. Further, the slide and the guide in the sewing head cannot be sufficiently lubricated since the lubrication inside the sewing head should be effected so as to avoid contamination of the work fabric with a lubricating oil. In this respect, this upper fabric feed device is not suitable for a sewing machine adapted to operate at a high speed.

On the other hand, the latter conventional device which uses the two motion mechanisms and many connecting members including the two equal-length connecting links is inevitably complicated with a large number of components accommodated within the sewing head.

SUMMARY OF THE INVENTION

It is therefore an object of the present invention to provide an upper fabric feed device for a sewing machine, which does not require a slide-and-guide assembly that should be lubricated, and which uses a feet operating mechanism of a simple construction capable of operating the feed and presser feet such that the velocities of these feet are zeroed or made close to zero when they contact or engage the work fabric.

The above object may be achieved according to the principle of this invention, which provides an upper fabric feed device for a sewing machine, including a frame, a feed foot for feeding a work fabric, a presser foot cooperating with the feed foot to hold the work fabric, and a feet reciprocating mechanism including a drive device, for alternately reciprocating the feed and presser feet toward and away from a throat plate, the feet reciprocating mechanism comprising: (a) a first swing arm pivotally supported by the frame and pivoted alternately in clockwise and counterclockwise directions by the drive device; (b) a parallel motion mechanism including four motion links pivotally connected to each other so as to define a parallelogram having four apexes, the parallel motion mechanism being supported by the frame pivotally about a first one of the four apexes; (c) a drive link mechanism including two drive links which pivotally connect the first swing arm to respective two motion links of one of two pairs of motion links, which two pairs consist of a first pair of adjacent motion links of the parallel motion mechanism which defines the first apex, and a second pair of adjacent motion links of the parallel motion mechanism which defines a second one of the four apexes opposed to the first apex diagonally of the parallelogram; (d) a second swing arm pivotally supported by the frame; (e) a first connecting link pivotally connected to at least one of the second pair of adjacent motion links of the parallel motion mechanism; (f) a triangular lever connected to the first connecting link and the second swing arm; (g) a second connecting link and a third connecting link connecting the triangular lever to the feed and presser feet, respectively; (h) biasing means for biasing the feed presser feet toward the throat plate, and wherein the feet reciprocating mechanism is adapted to operate such that the feed and presser feet are both placed in their lower positions for contact with the work fabric on the throat plate, when the parallel motion mechanism has a smallest distance between the first and second apexes.

In the upper fabric feed device of the present invention constructed as described above, bidirectional oscillation of the triangular lever causes alternate reciprocating movements (vertical lifting and lowering movements) of the feed and presser feet toward and away from the throat plate of the sewing machine. The oscillation of the triangular lever is effected by movements of the second apex of the parallel motion mechanism, which are activated by the drive device by means of the first swing arm. The second apex is diagonally opposed to the first apex at which the parallel motion mechanism is pivotally supported by the frame. The velocity of the movements of the second apex to oscillate the triangular lever is reduced to the lowest value when the second apex is closest to the first apex, namely, when the distance between the first and second apexes is the smallest. Where the four motion links defining the parallelogram of the parallel motion mechanism have the same length, the second apex is moved so as to be superposed on the first apex (i.e., the distance between the first and second apexes is zeroed) when the feed and presser feet are both lowered for contact with the work fabric on the throat plate. Therefore, the lowering velocity of the feed and presser feet upon contacting the work fabric is completely zeroed.

The present upper fabric feed device including the feet reciprocating mechanism which utilizes the parallel motion mechanism is capable of alternately reciprocating the feed and presser feet between the upper and lower positions, such that the velocity at which the feet are lowered to the lower position for contact with the work fabric is decelerated to zero or to a level close to zero when the lower position is reached. Accordingly, the fabric feed device assures a quiet and smooth sewing operation without unfavorable bouncing and damaging of the feed and presser feet and work fabric, even if the sewing operation is effected at a considerably high speed. The parallel motion mechanism is a simple link mechanism, which replaces the conventionally used slide-and-guide assembly which should be lubricated.

BRIEF DESCRIPTION OF THE DRAWINGS

The above and optional objects, features and advantages of this invention will be better understood by reading the following detailed description of presently preferred embodiments of the invention, when considered in connection with the accompanying drawings, in which.

DESCRIPTION OF THE PREFERRED EMBODIMENTS

Figure 1:
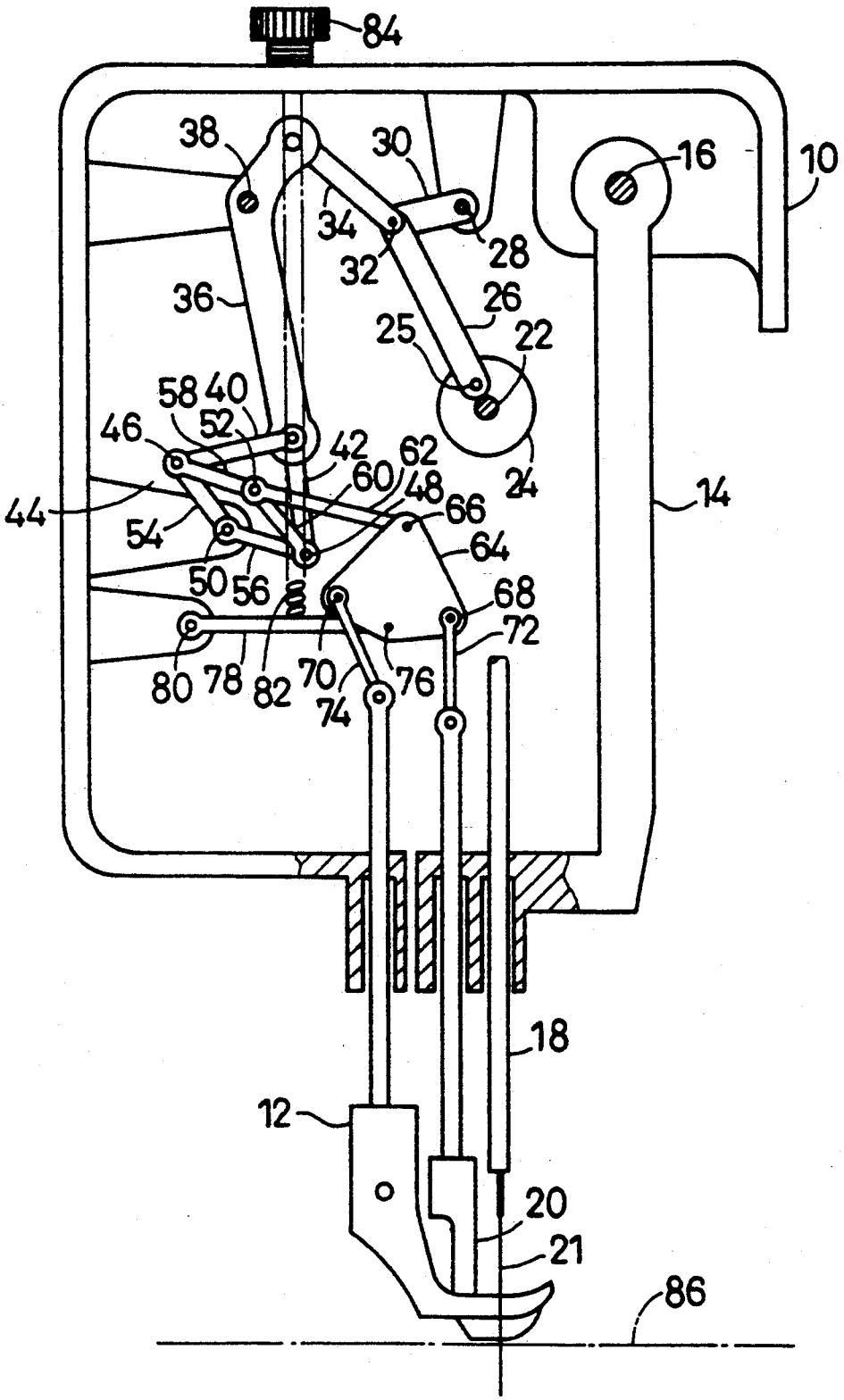
FIG. 1 is a front elevational view of a head of a sewing machine, which incorporates one embodiment of an upper fabric feed device of the present invention.

Referring first to FIG. 1, there is shown a sewing head of a sewing machine which incorporates an upper fabric feed device constructed according to one presently preferred embodiment of the present invention. The fabric feed device has a holddown foot or presser foot 12 carried by a rod which is vertically reciprocable slidably with respect to a frame 10 of the sewing head. Thus, the presser foot 12 is vertically reciprocable between its upper and lower positions. The head frame 10 has a pivot pin 16 so that a swing lever 14 is pivotable at its upper end about the horizontal axis of the pivot pin 16. A needle bar 18 carrying a needle 21, and a rod carrying a feed foot 20 slidably extend through the lower end portion of the swing lever 14, so that the needle bar 18 and the feed foot 20 are vertically reciprocable between their upper and lower positions. The swing lever 14 is pivoted by a suitable mechanism in synchronization with the rotating motion of a spindle of the sewing machine, to produce back and forth movements of the feed foot 20 together with the needle bar 18, so that the work fabric placed on a stitch plate or throat plate 86 is incrementally fed by the feed foot 20, in a direction perpendicular to the direction of reciprocation of the feed foot 20. The throat plate 86 is indicated by a one-dot chain line in FIGS. 1–5.

The upper fabric feed device further includes a drive shaft 22 which is rotated in synchronization with the machine spindle. To this drive shaft 22, there is fixed a rotary member in the form of a crank disk 24 having a pivot pin 25, which is offset from the axis of the drive shaft 22 by a suitable radial distance. A connecting link 26 is pivotally connected at its one end to the pivot pin 25, and at the other end to a pivot pin 32 at one end of a pivot link 30, which is pivotally connected at the other end to a pivot pin 28 provided on the frame 10. The pivot pin 32 is connected, by a connecting link 34, to one end of a first swing arm in the form of a bell crank 36. The drive shaft 22 and the rotary member 24 constitute a crank mechanism for pivoting the bell crank 36 alternately in the clockwise and counterclockwise directions, as described below.

The bell crank 36 is supported by the frame 10, pivotally about a pivot pin 38, at a point intermediate between its opposite ends. At the end opposite to the end connected to the connecting link 34, the bell crank 36 is connected to a parallel motion mechanism 44 via two drive links 40, 42.

The parallel motion mechanism 44 consists of four motion links 54, 56, 58, 60 having the same length, which are connected to each other so as to define a parallelogram having four apexes 46, 48, 50, 52. The parallel motion mechanism 44 is supported by the frame 10, rotatably about the apex 50. The two drive links 40, 42 indicated above are connected to the apexes 46, 48 which are adjacent to the apex 50. The apex 52 opposed to the apex 50 diagonally of the parallelogram is connected by a connecting link 62 to a top apex 66 of a triangular or ternary lever 64, such that the connecting link 62 is pivotable at its opposite ends about the respective apexes 52, 66.

The triangular lever 64 constitutes a part of a feet reciprocating mechanism for lifting and lowering the feed foot 20 and the presser foot 12. The triangular lever 64 is connected pivotally at its two bottom apexes 68, 70 to respective connecting links 72, 74, which in turn are pivotally connected to the respective rods of the feed and presser feet 20, 12, respectively. The lever 64 has a pivot pin 76 at a bottom portion thereof, between the two bottom apexes 68, 70, and is connected pivotally about this pivot pin 76 to one end of a second swing arm in the form of a swing arm 78, which assumes a generally horizontal attitude. The swing arm 78 is connected pivotally at the other end to the machine frame 10. The swing arm 78 is biased in the vertically downward direction by a compression coil spring 82. The biasing force of the compression coil spring 82 can be suitably adjusted by turning an adjusting screw 84 rotatably provided on the frame 10.

There will next be described an operation of the upper fabric feed device, in particular, the feet reciprocating mechanism, by reference to FIGS. 2–5 in which some of the reference numerals in FIG. 1 are omitted in the interest of simplification.

Figure 2:
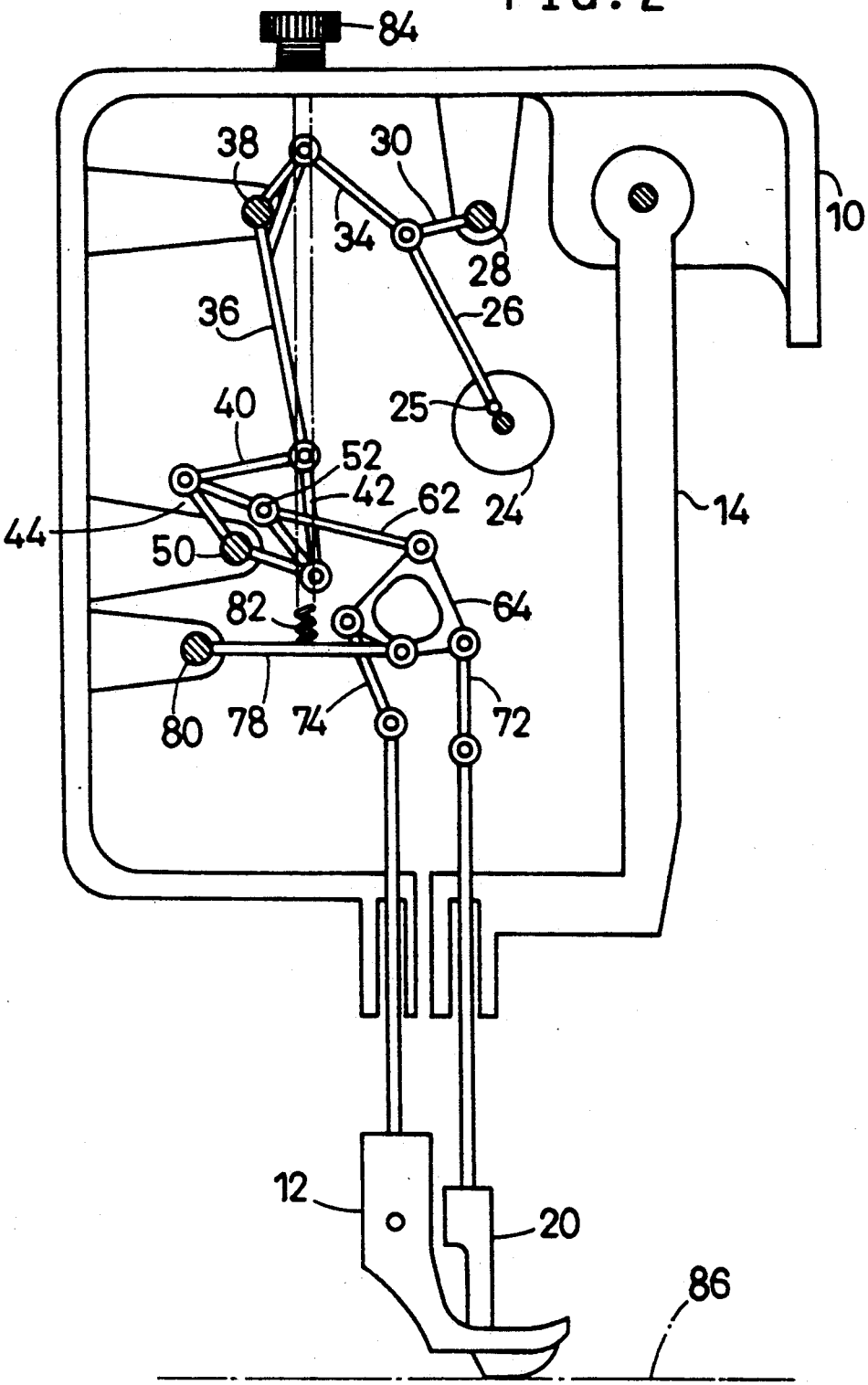
FIGS. 2 through 5 are schematic front elevational views showing the sewing head of FIG. 1 in different operating phases.

In an operating phase of FIG. 2 of the fabric feed device, the eccentric pivot pin 25 on the crank disk 24 is at the eleven o'clock position. In this phase, the bell crank 36 has the maximum angle of counterclockwise rotation, whereby the apex 52 diagonal to the pivot axis 50 of the parallel motion mechanism 44 is located at the rightmost position. In the present operating phase of FIG. 2, therefore, the triangular lever 64 is in a rightward inclined position as seen in FIG. 2, whereby the feed foot 20 is in the lower position pressing the work fabric against the throat plate 86 under the biasing force of the compression coil spring 82, while the presser foot 12 is in the upper position spaced from the throat plate 86 in the upward direction. The biasing force acting on the feed foot 20 is adjustable by the adjusting screw 84.

When the crank disk 24 is rotated clockwise from the position of FIG. 2, the lower end of the bell crank 36 is moved to the left whereby the diagonally opposed apexes 50, 52 of the parallel motion mechanism 44 are moved toward each other so as to reduce the distance therebetween. With this movement of the mechanism 44, the triangular lever 64 is rotated or oscillated counterclockwise toward a vertically upright position of FIG. 3, and the presser foot 12 is lowered toward the throat plate 86.

Figure 3:
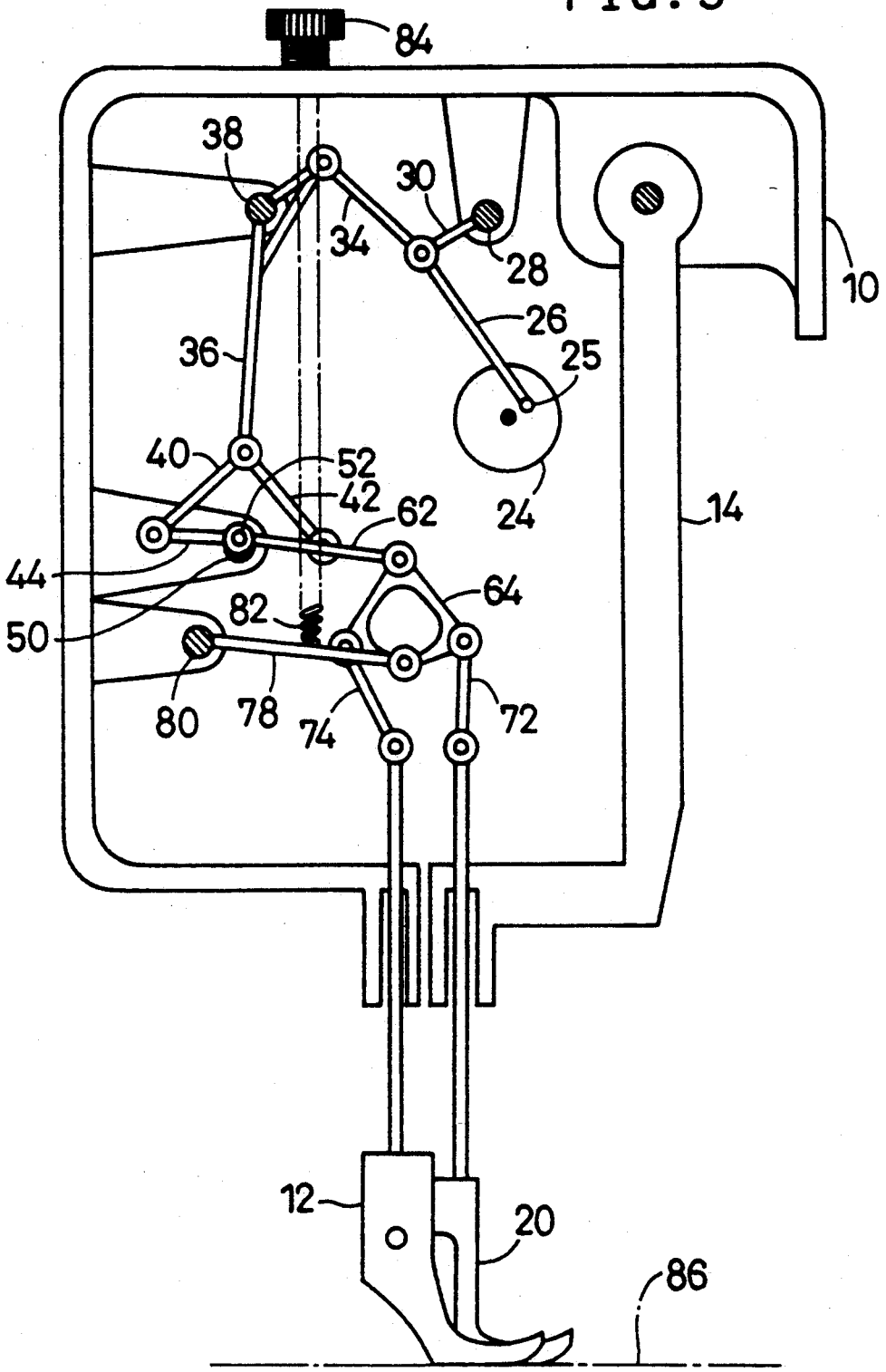

When the eccentric pivot pin 25 reaches the two o'clock position on the crank disk 24, as shown in FIG. 3, the two apexes 50, 52 of the parallel motion mechanism 44 are substantially superposed on each other with substantially no distance therebetween, namely, the two pairs of adjacent motion links 54, 56 and 58, 60 of the mechanism 44 are superposed on each other so as to define a substantially straight line, as shown in FIG. 3. In this operating phase of the fabric feed device, the presser foot 12 is in the lower position pressing the work fabric against the throat plate 86. When the presser foot 12 is lowered, the lowering velocity is zeroed when the foot 12 has reached the lower position in which the foot 12 is in pressing contact with the work fabric on the throat plate 86.

When the crank disk 24 is further rotated in the clockwise direction, the lower end of the bell crank 36 is further moved in the leftward direction, moving the diagonally opposed apexes 50, 52 of the parallel motion mechanism 44 away from each other, whereby the triangular lever 64 is rotated a further angle in the counterclockwise direction toward a leftward inclined position, whereby the feed foot 20 is lifted while the presser foot 12 is held pressed toward the throat plate 86 under the biasing force of the coil spring 82.

Figure 4:
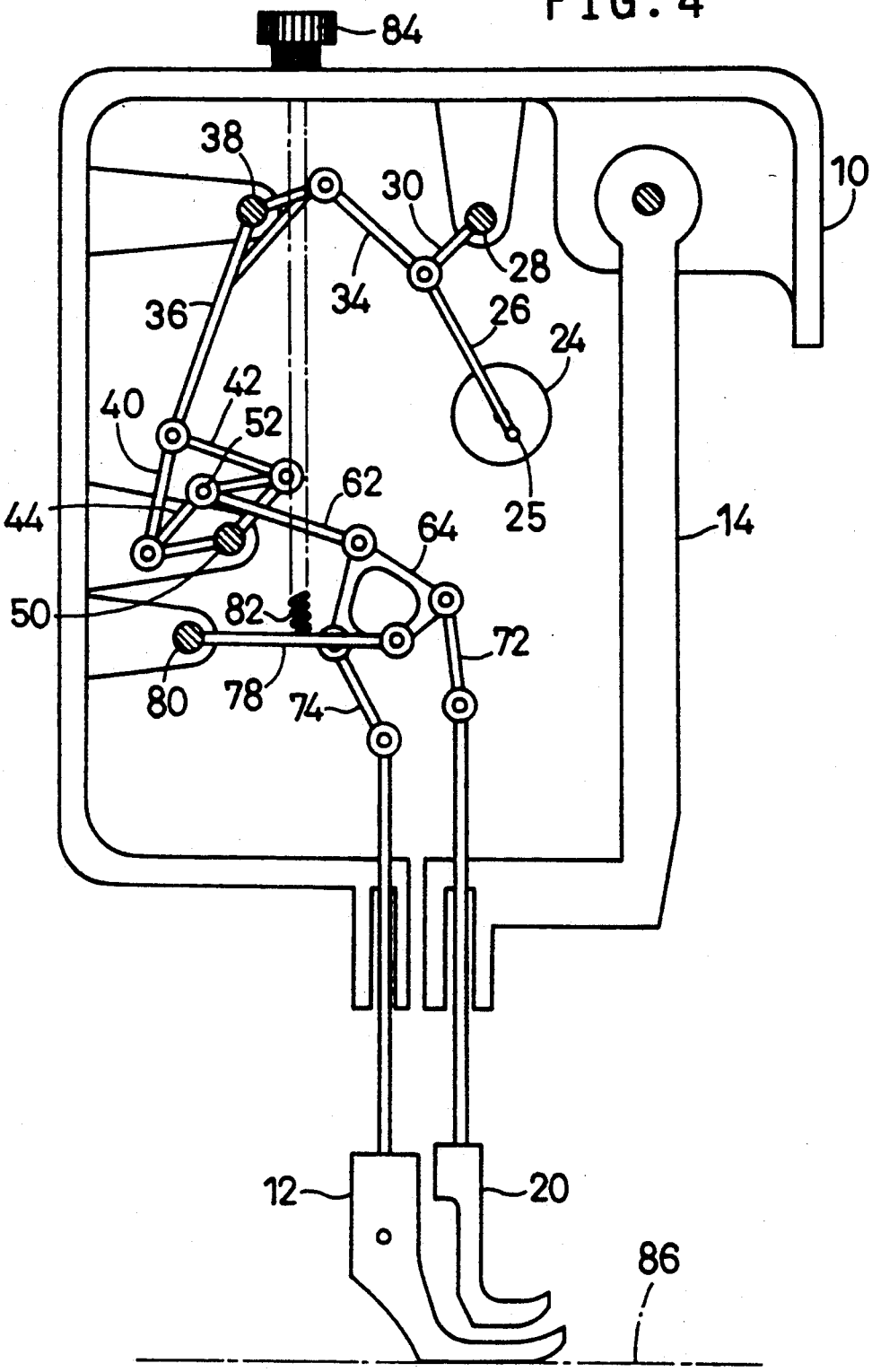

When the eccentric pivot pin 25 reaches the five o'clock position on the crank disk 24, as shown in FIG. 4, the bell crank 36 has the maximum angle of clockwise rotation, and the apex 52 is in the leftmost position, having the maximum distance from the opposite apex 50. In this operating phase of FIG. 4, the triangular lever 64 is in the leftward inclined position, whereby the feed foot 20 is in the upper position.

With a further clockwise rotation of the crank disk 24, the lower end of the bell crank 36 is moved to the right, and the diagonally opposed apexes 50, 52 are moved toward each other so as to reduce the distance therebetween. As a result, the triangular lever 64 is rotated or oscillated clockwise toward the vertically upright position of FIG. 5, whereby the feed foot 20 is lowered toward the throat plate 86, while the presser foot 12 is held pressed toward the plate 86 by the coil spring 82.

Figure 5:
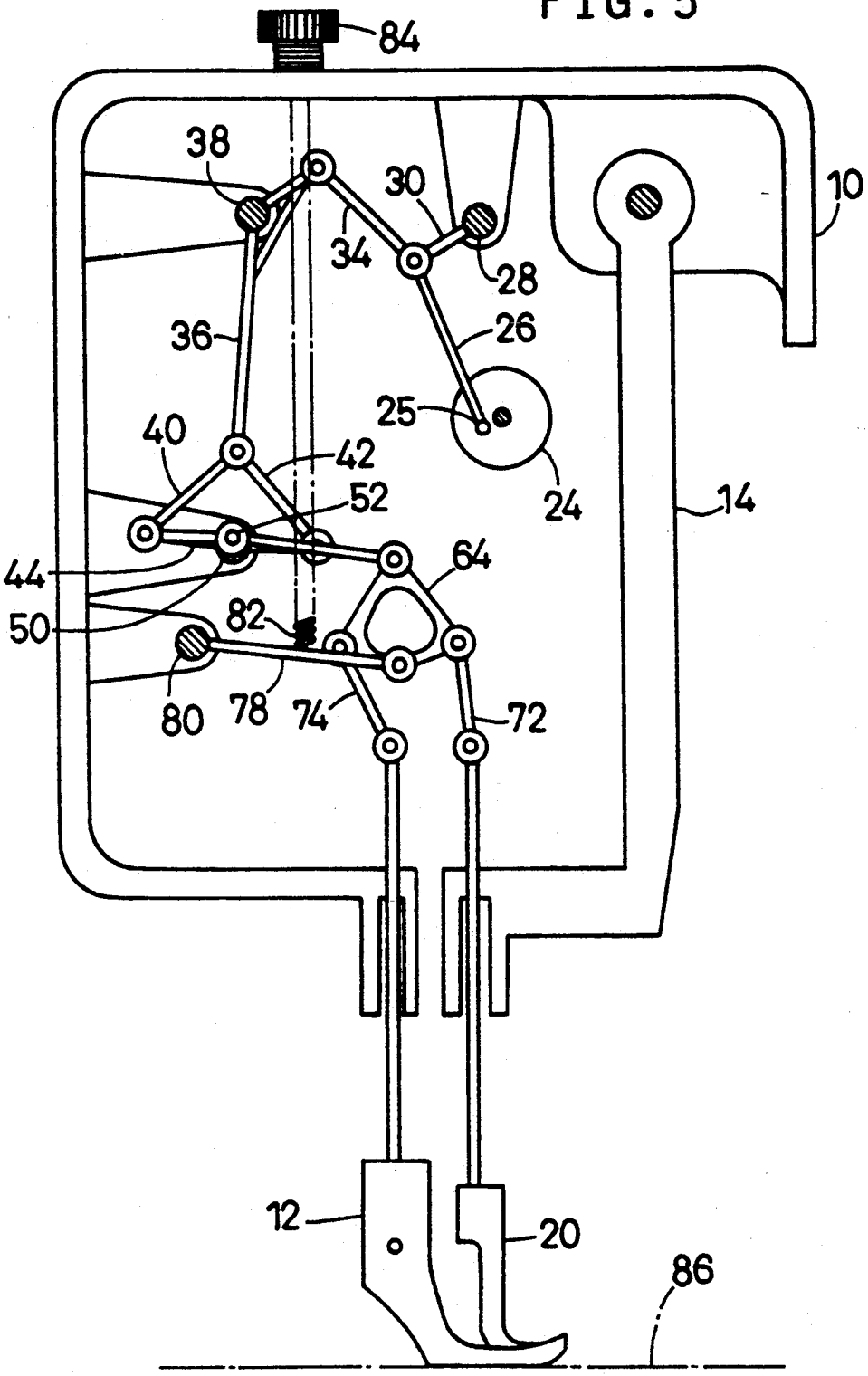

When the eccentric pivot pin 25 reaches the eight o'clock position on the disk 24, the diagonally opposed apexes 50, 52 of the parallel motion mechanism 44 are substantially superposed on each other with substantially no distance therebetween, and the triangular lever 64 takes the vertically upright position of FIG. 5. When the feed foot 20 is lowered toward the lower position, the lowering velocity is zero when the feed foot 20 has reached the lower position at which the work fabric is pressed by the foot 20 against the throat plate 86.

With a further clockwise rotation of the crank disk 24, the lower end of the bell crank 36 is further moved to the right, with the opposed apexes 50, 52 moving away from each other, whereby the triangular lever 64 is rotated clockwise toward the rightward inclined position of FIG. 2. As a result, the operating phase of FIG. 2 is re-established, namely, the presser foot 12 is lifted, while the feed foot 20 is held pressed against the work fabric on the throat plate 86, under the biasing action of the coil spring 82.

Thus, the upper fabric feed device has a total of four operating phases of FIGS. 2-5, which are sequentially established when the crank disk 24 is rotated in the clockwise direction.

Figure 6:
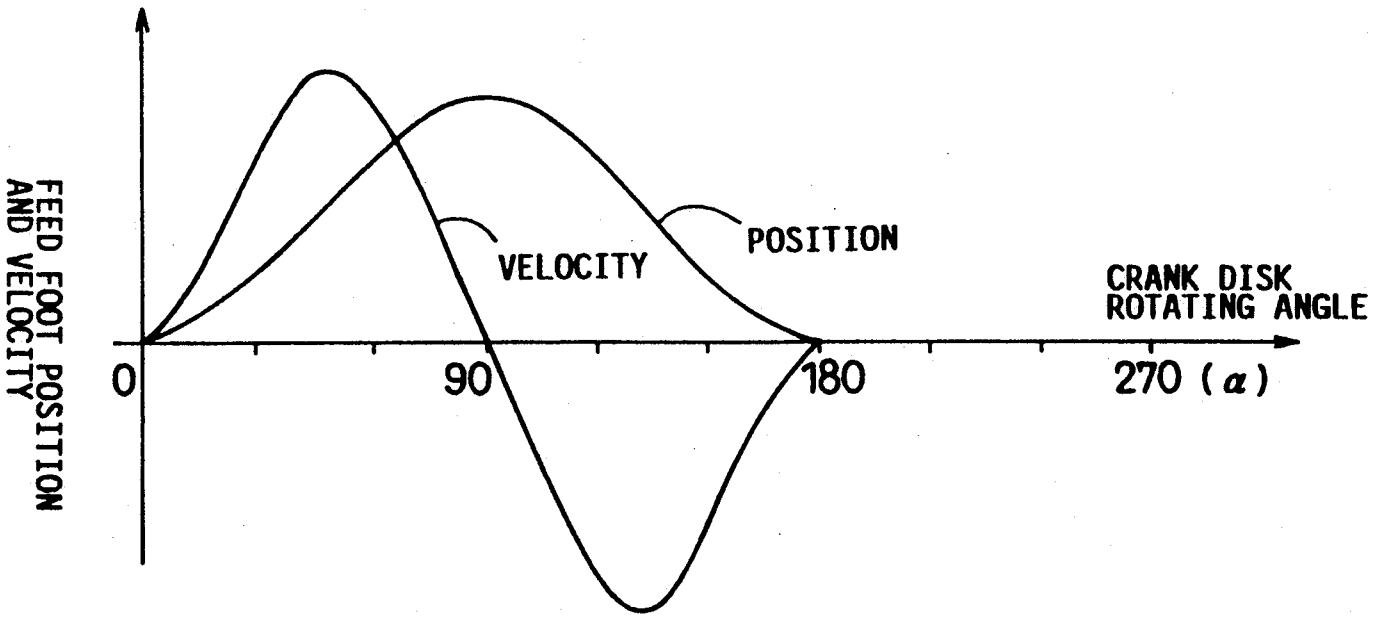
FIG. 6 is a diagram showing the operating velocity and position of the feed foot of the upper fabric feed device, which change as a function of the rotating angle of the crank disk of the feed device when the crank disk is rotated from the position of FIG. 3 to the position of FIG. 5.

Referring next to FIG. 6, there is shown a relationship between the position [height from the throat plate 86) of the feed foot 20 and the lowering and lifting velocity of the feed foot 20, when the crank disk 24 is rotated from the position of FIG. 3 (two o'clock position of the pivot pin 25) to the position of FIG. 5 (eight o'clock position of the pivot pin 25). Two curves in FIG. 6 indicating changes in the position and velocity of the feed foot 20 show that the velocity of the feed foot 20 is slowed down to zero when when the feed foot 20 reaches its lower position for pressing contact with the work fabric on the throat plate 86. This arrangement prevents bouncing of the feed foot 20 upon contacting with the work fabric, and damaging of the work fabric by the feed foot 20.

It will be understood that the position and the velocity of the presser foot 12 have the same relationship as those of the feed foot 20, although the operating phases of the feed and presser feet 20, 12 are shifted 180° from each other.

In the present upper fabric feed device utilizing the parallel motion mechanism 44 to alternately lift and lower the presser and feed feet 12, 20, the lowering velocities of these feet 12, 20 are zeroed when they are brought into contact with the work fabric. The present embodiment permits a quiet and smooth sewing operation without undesirable bouncing and damaging of the feet 12, 20 and work fabric, even if the operation is effect at a considerably high speed.

While the drive links 40, 42 are connected to the apexes 46, 48 of the parallelogram of the parallel motion mechanism 44 in the embodiment of FIGS. 1-5, the upper fabric feed device may be modified in the parallel motion mechanism and drive link mechanism, as desired, within the principle of this invention, as described below.

Figure 7A:
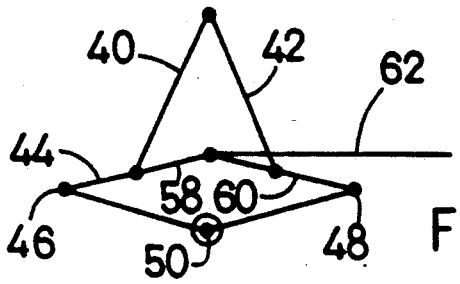
FIGS. 7(*a*), 7(*b*) and 7(*c*) are schematic views showing other embodiments of this invention.
Figure 7B:
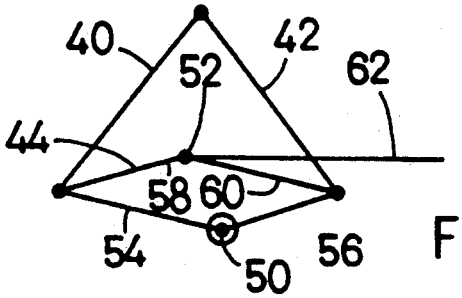
Figure 7C:
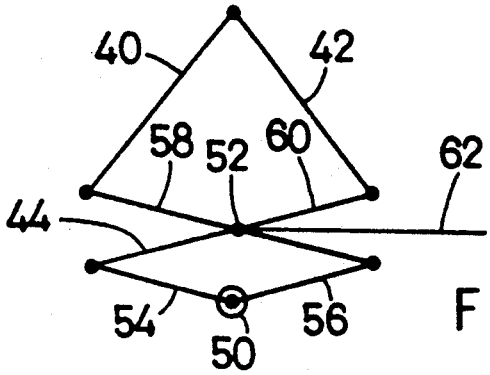

FIG. 7(*a*) shows a modified embodiment in which the drive links 40, 42 are not connected to the apexes 46, 48 of the parallel motion mechanism 44, but connected to intermediate portions of the respective motion links 58, 60 of the mechanism 44.

In another modified embodiment illustrated in FIG. 7(*b*), the four motion links 54, 56, 58, 60 of the mechanism 44 do not have the same length. That is, the two parallel opposed links 54, 60 have the same length, while the other two parallel opposed motion links 56, 58 have the same length, which is smaller than the length of the motion links 54, 60. In this arrangement, the lowering velocities of the presser and feed feet 12, 20 upon contacting with the work fabric (throat plate 86) cannot be completely zero, but can be made almost zero or very close to zero.

A further modified embodiment is illustrated in FIG. 7(*c*), wherein the two drive links 40, 42 are connected to the ends of extensions of the motion links 58, 60 of the parallel motion mechanism 44.

Figure 8A:
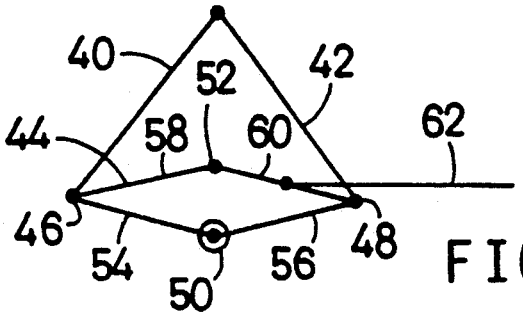
FIGS. 8(*a*) and 8(*b*) are schematic view showing further embodiments of the invention.
Figure 8B:
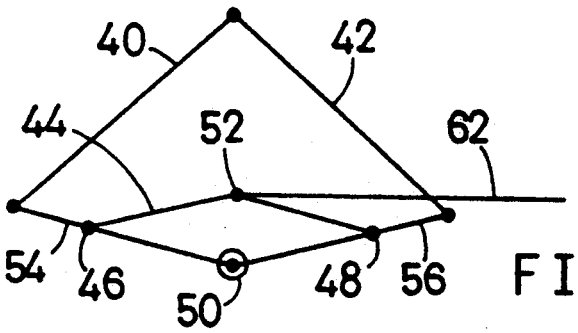

In the above embodiments, the parallel motion mechanism 44 is connected at its top apex 52 to the triangular lever 64 by the connecting link 62. However, the connecting link 62 may be connected to an intermediate portion of the link 60 of the mechanism 44, as shown in FIG. 8(*a*). In this instance, the lowering velocities of the presser and feed feet 12, 20 upon contacting with the work fabric cannot be completely zero, but can be made almost zero or very close to zero.

In still another modified embodiment illustrated in FIG. 8(*b*), the drive links 40, 42 are connected to the ends of extensions of the motion links 54, 56 of the parallel motion mechanism 44 which are adjacent to the pivot apex 50.

While the present invention has been described above in its presently preferred embodiments with certain degrees of particularity, it is to be understood that the invention is not limited to the details of the illustrated embodiments, but may be embodied with various changes, modifications and improvements, which occur to those skilled in the art, without departing from the spirit and scope of the invention defined in the following claims.

What is claimed is:

1. An upper fabric feed device for a sewing machine, including a frame, a feed foot for feeding a work fabric on a throat plate, a presser foot cooperating with the feed foot to hold the work fabric, and a feet reciprocating mechanism including a drive device, for alternately reciprocating the feed and presser feet to and from lower positions thereof at which said feed and presser feet contact said work fabric on said throat plate, said feet reciprocating mechanism comprising:

a first swing arm pivotally supported by said frame and pivoted alternately in clockwise and counterclockwise directions by said drive device;

a parallel motion mechanism including four motion links pivotally connected to each other so as to define a parallelogram having four apexes, said parallel motion mechanism being supported by said frame pivotally about a first one of said four apexes, said four motion links comprising a first pair of adjacent motion links which defines said first apex, and a second pair of adjacent motion links which defines a second one of said four apexes which is opposed to said first apex diagonally of said parallelogram;

a drive link mechanism including two drive links which pivotally connect said first swing arm to respective two motion links of one of said first and second pairs of adjacent motion links of said parallel motion mechanism;

a second swing arm pivotally supported by said frame;

a first connecting link pivotally connected to at least one of said second pair of adjacent motion links of said parallel motion mechanism;

a triangular lever connected to said first connecting link and said second swing arm;

a second connecting link and a third connecting link connecting said triangular lever to said feed and presser feet, respectively;

biasing means for biasing said feed and presser feet toward said throat plate; and said feet reciprocating mechanism operating such that said feed and presser feet are both placed in said lower positions for contact with said work fabric on said throat plate, when said parallel motion mechanism has a smallest distance between said first and second apexes.

2. An upper fabric feed device according to claim 1, wherein said four motion links of said parallel motion mechanism have a same length.

3. An upper fabric feed device according to claim 2, wherein said feed and presser feet are both placed in said lower positions when said first and second apexes are superposed on each other.

4. An upper fabric feed device according to claim 1, wherein said two drive links of said drive link mechanism connect said first swing arm to the respective two apexes of said parallel motion mechanism other than said first and second apexes.

5. An upper fabric feed device according to claim 1, wherein said two drive links of said drive link mechanism connect said first swing arm to intermediate portions of said second pair of adjacent motion links of said parallel motion mechanism, respectively.

6. An upper fabric feed device according to claim 1, wherein said two drive links of said drive link mechanism connect said first swing arm to respective extensions of said second pair of adjacent motion links of said parallel motion mechanism, which extensions extend from ends of said second pair of adjacent motion links which are connected to said second apex.

7. An upper fabric feed device according to claim 1, wherein said two drive links of said drive link mechanism connect said first swing arm to respective extensions of said first pair of adjacent motion links of said parallel motion mechanism, which extensions extend from ends of said first pair of adjacent motion links which are connected to said first apex.

8. An upper fabric feed device according to claim 1, wherein said first connecting link connects said second apex of said parallel motion mechanism and said triangular lever.

9. An upper fabric feed device according to claim 1, wherein said first connecting link connects an intermediate portion of one of said second pair of adjacent motion links of said parallel motion mechanism and said triangular lever.

10. An upper fabric feed device according to claim 1, wherein said drive device includes a crank mechanism having a rotary member rotated about an axis, and further includes a fourth connecting link connecting said crank mechanism to said first swing arm, said first swing arm being pivoted alternately in the clockwise and counterclockwise directions when said rotary member is rotated.

11. An upper fabric feed device according to claim 1, wherein said first swing arm comprises a bell crank having two arms extending from a pivot axis at which said bell crank is pivotally supported by said frame, said drive device being connected to one of said two arms, and said drive link mechanism being connected to the other of said two arms.

12. An upper fabric feed device according to claim 1, wherein said biasing means includes a spring disposed between said second swing arm and said frame, said spring acting on said second swing arm and thereby biasing said feed and presser feet, said triangular lever and said third and fourth connecting links.

13. An upper fabric feed device according to claim 1, wherein said first connecting link is connected to a first apex of said triangular lever, and said second and third connecting links are connected to a second and a third apex of said triangular lever, said second swing arm being connected to a portion of said triangular lever which is offset from said first apex of said triangular lever.

14. An upper fabric feed device according to claim 1, wherein said portion of said triangular lever to which said second swing arm is connected is located substantially intermediate between said second and third apexes of said triangular lever.

* * * * *